US009486390B2

(12) United States Patent
Centen et al.

(10) Patent No.: US 9,486,390 B2
(45) Date of Patent: Nov. 8, 2016

(54) REFERENCE SENSOR FOR CPR FEEDBACK DEVICE

(75) Inventors: Corey J. Centen, Toronto (CA); Sarah A. Smith, Hamilton (CA); Gregory V. Browne, Redmond, WA (US); Ryan D. Lee, Victoria (CA); Maegan P. Wilkinson, Seattle, WA (US); Richard C. Nova, Kirkland, WA (US)

(73) Assignee: PHYSIO-CONTROL, INC., Redmond, WA (US)

( * ) Notice: Subject to any disclaimer, the term of this patent is extended or adjusted under 35 U.S.C. 154(b) by 908 days.

(21) Appl. No.: 13/250,974

(22) Filed: Sep. 30, 2011

(65) Prior Publication Data

US 2012/0083720 A1 Apr. 5, 2012

Related U.S. Application Data

(60) Provisional application No. 61/388,461, filed on Sep. 30, 2010.

(51) Int. Cl.
*A61H 31/00* (2006.01)

(52) U.S. Cl.
CPC ..... *A61H 31/007* (2013.01); *A61H 31/005* (2013.01); *A61H 2201/5061* (2013.01); *A61H 2201/5064* (2013.01); *A61H 2201/5071* (2013.01); *A61H 2201/5084* (2013.01); *A61H 2201/5097* (2013.01)

(58) Field of Classification Search
CPC .. A61H 31/00; A61H 31/005; A61H 31/007; A61H 2201/5084; A61H 2201/5061; A61H 2201/5064; A61H 2201/5071; A61H 2201/5097
USPC ..... 601/41–44; 600/587; 434/265
See application file for complete search history.

(56) References Cited

U.S. PATENT DOCUMENTS

| | | | | |
|---|---|---|---|---|
| 3,804,082 | A * | 4/1974 | Tarjan et al. | 601/41 |
| 3,870,038 | A * | 3/1975 | Arblaster | 601/41 |
| 5,269,324 | A * | 12/1993 | Butterfield | A61G 7/1023 128/875 |
| 6,306,107 | B1 * | 10/2001 | Myklebust et al. | 600/587 |
| 7,220,235 | B2 * | 5/2007 | Geheb et al. | 601/41 |
| 2005/0080364 | A1 * | 4/2005 | Jensen et al. | 601/44 |
| 2006/0015044 | A1 * | 1/2006 | Stavland et al. | 601/41 |
| 2008/0124509 | A1 * | 5/2008 | Boise | G06F 3/0395 428/45 |
| 2010/0022904 | A1 * | 1/2010 | Centen | 600/534 |
| 2010/0228165 | A1 * | 9/2010 | Centen | 601/41 |

* cited by examiner

*Primary Examiner* — Justine Yu
*Assistant Examiner* — Timothy Stanis
(74) *Attorney, Agent, or Firm* — Marger Johnson

(57) ABSTRACT

Embodiments of the present concept are directed to medical devices for use by a rescuer who is caring for a patient and includes a bottom device for use with a top device to measure the depth of Cardio Pulmonary Resuscitation (CPR) chest compressions delivered to the chest of a patient. The top device is intended for placement on the chest of the patient and has a top mechanism that is moveable up and down as the chest compressions are delivered to the patient. The bottom device includes a generally elongate member having a handle at one end and a bottom mechanism near the opposite end. The elongate member is structured to be placed under the patient during delivery of CPR. The top mechanism and the bottom mechanism cooperate to generate a value for a net depth of the compressions of the patient chest with reference to each other.

25 Claims, 9 Drawing Sheets

*EXAMPLE FEATURES OF BOTTOM DEVICE*

FIG. 1 DEVICE TO MEASURE CPR COMPRESSION DEPTH

*NET DEPTH MEASUREMENT BETWEEN TOP AND BOTTOM MECHANISMS*

FIG. 3 *TETHERED CONNECTION BETWEEN TOP DEVICE AND BOTTOM DEVICE*

*COMPONENTS OF TOP DEVICE AND BOTTOM DEVICE WITH REFERENCE SENSOR FOR CPR FEEDBACK*

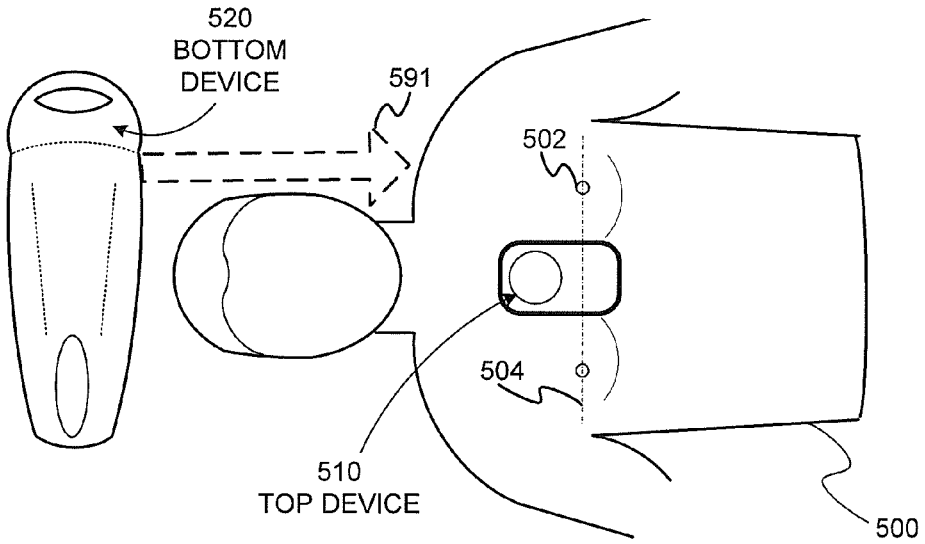
FIG. 5A MEDICAL ASSIST SCENE
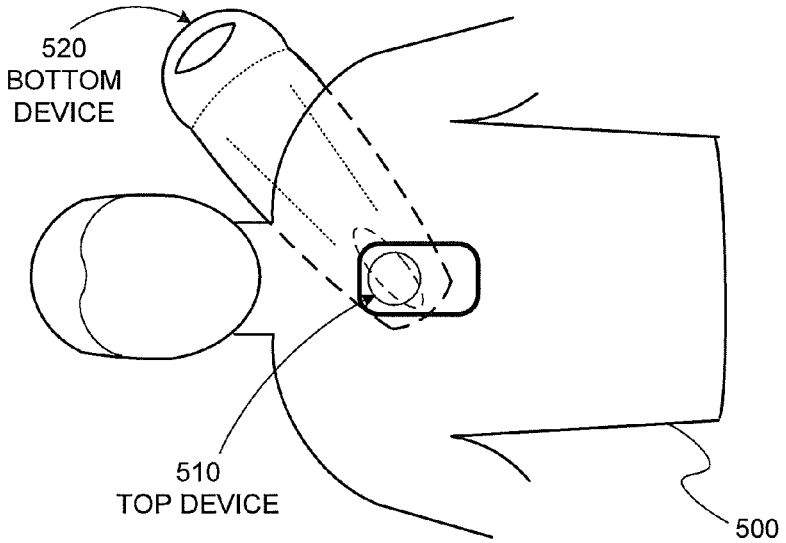
FIG. 5B EXAMPLE POSITIONING OF TOP AND BOTTOM DEVICE IN MEDICAL ASSIST SCENE

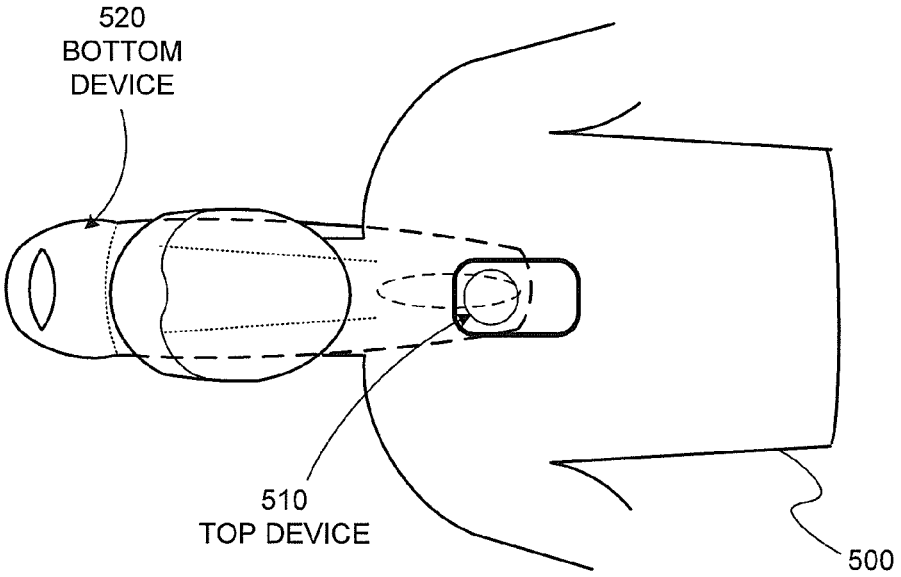
FIG. 5C EXAMPLE POSITIONING OF TOP AND BOTTOM DEVICE IN MEDICAL ASSIST SCENE
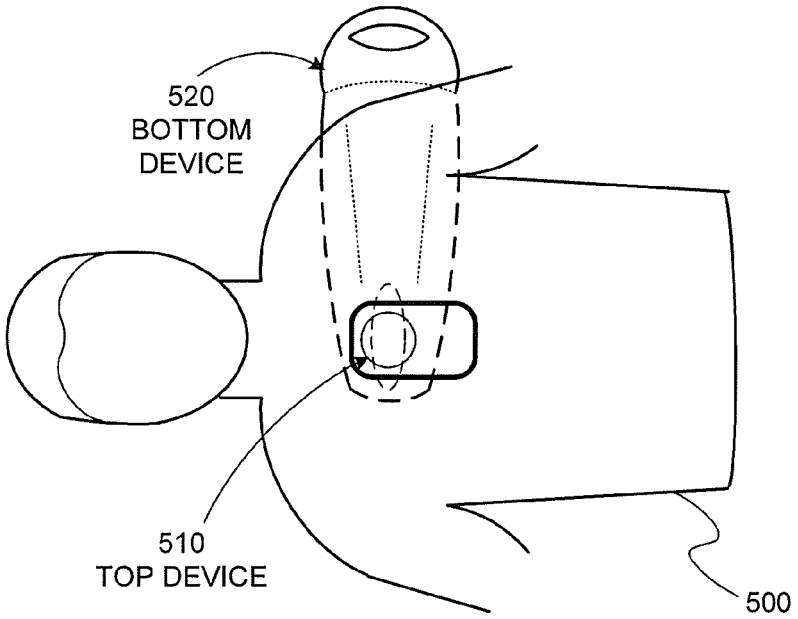
FIG. 5D EXAMPLE POSITIONING OF TOP AND BOTTOM DEVICE IN MEDICAL ASSIST SCENE

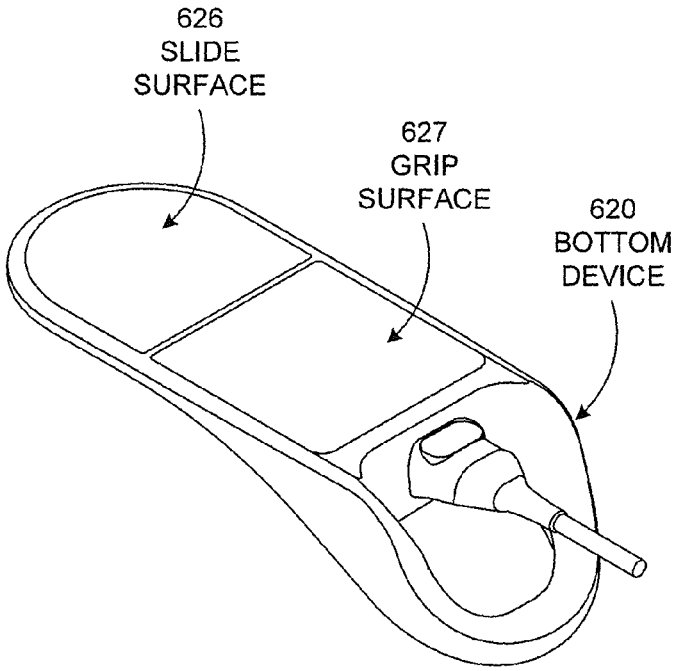
FIG. 6 EXAMPLE FEATURES OF BOTTOM DEVICE

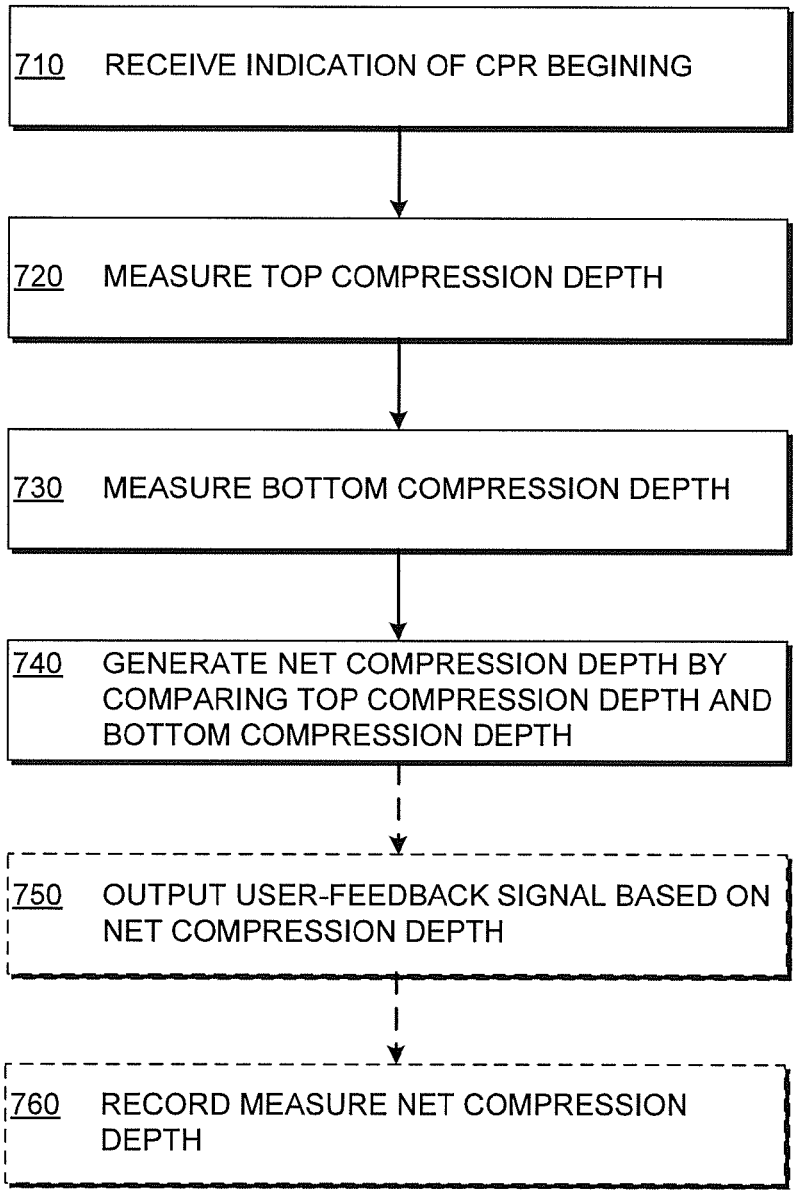
FIG. 7 *METHOD OF DETERMINING COMPRESSION DEPTH DURING CPR*

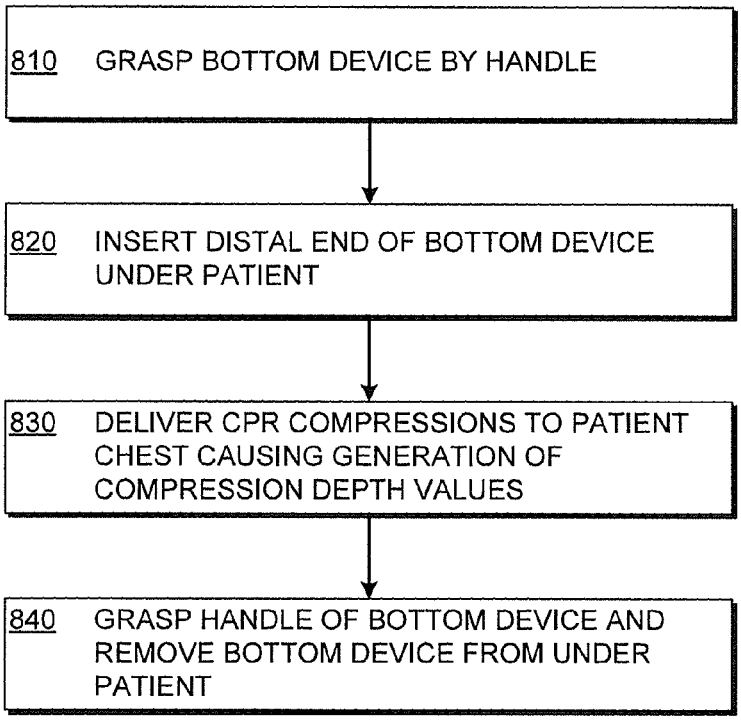
FIG. 8 *METHOD OF DETERMINING COMPRESSION DEPTH DURING CPR*

REFERENCE SENSOR FOR CPR FEEDBACK DEVICE

CROSS REFERENCE TO RELATED PATENT APPLICATIONS

This patent application claims priority from U.S.A. Provisional Patent Application Ser. No. 61/388,461 entitled REFERENCE SENSOR EMBODIMENT FOR CPR FEEDBACK DEVICE, filed on Sep. 30, 2010, the disclosure of which is hereby incorporated by reference for all purposes.

FIELD

This application generally relates to medical devices.

BACKGROUND

In humans, the heart beats to sustain life. In normal operation, it pumps blood through the various parts of the body. More particularly, the various chamber of the heart contract and expand in a periodic and coordinated fashion, which causes the blood to be pumped regularly. More specifically, the right atrium sends deoxygenated blood into the right ventricle. The right ventricle pumps the blood to the lungs, where it becomes oxygenated, and from where it returns to the left atrium. The left atrium pumps the oxygenated blood to the left ventricle. The left ventricle, then, expels the blood, forcing it to circulate to the various parts of the body.

The heart chambers pump because of the heart's electrical control system. More particularly, the sinoatrial (SA) node generates an electrical impulse, which generates further electrical signals. These further signals cause the above-described contractions of the various chambers in the heart, in the correct sequence. The electrical pattern created by the sinoatrial (SA) node is called a sinus rhythm.

Sometimes, however, the electrical control system of the heart malfunctions, which can cause the heart to beat irregularly, or not at all. The cardiac rhythm is then generally called an arrhythmia. Arrhythmias may be caused by electrical activity from locations in the heart other than the SA node. Some types of arrhythmia may result in inadequate blood flow, thus reducing the amount of blood pumped to the various parts of the body. Some arrhythmias may even result in a Sudden Cardiac Arrest (SCA). In a SCA, the heart fails to pump blood effectively, and, if not treated, death can occur. In fact, it is estimated that SCA results in more than 250,000 deaths per year in the United States alone. Further, a SCA may result from a condition other than an arrhythmia.

One type of arrhythmia associated with SCA is known as Ventricular Fibrillation (VF). VF is a type of malfunction where the ventricles make rapid, uncoordinated movements, instead of the normal contractions. When that happens, the heart does not pump enough blood to deliver enough oxygen to the vital organs. The person's condition will deteriorate rapidly and, if not reversed in time, they will die soon, e.g. within ten minutes.

Ventricular Fibrillation can often be reversed using a life-saving device called a defibrillator. A defibrillator, if applied properly, can administer an electrical shock to the heart. The shock may terminate the VF, thus giving the heart the opportunity to resume pumping blood. If VF is not terminated, the shock may be repeated, often at escalating energies.

A challenge with defibrillation is that the electrical shock must be administered very soon after the onset of VF. There is not much time: the survival rate of persons suffering from VF decreases by about 10% for each minute the administration of a defibrillation shock is delayed. After about 10 minutes the rate of survival for SCA victims averages less than 2%.

The challenge of defibrillating early after the onset of VF is being met in a number of ways. First, for some people who are considered to be at a higher risk of VF or other heart arrhythmias, an Implantable Cardioverter Defibrillator (ICD) can be implanted surgically. An ICD can monitor the person's heart, and administer an electrical shock as needed. As such, an ICD reduces the need to have the higher-risk person be monitored constantly by medical personnel.

Regardless, VF can occur unpredictably, even to a person who is not considered at risk. As such, VF can be experienced by many people who lack the benefit of ICD therapy. When VF occurs to a person who does not have an ICD, they collapse, because blood flow has stopped. They should receive therapy quickly.

For a VF victim without an ICD, a different type of defibrillator can be used, which is called an external defibrillator. External defibrillators have been made portable, so they can be brought to a potential VF victim quickly enough to revive them.

During VF, the person's condition deteriorates, because the blood is not flowing to the brain, heart, lungs, and other organs. Blood flow must be restored, if resuscitation attempts are to be successful.

Cardiopulmonary Resuscitation (CPR) is one method of forcing blood flow in a person experiencing cardiac arrest. In addition, CPR is the primary recommended treatment for some patients with some kinds of non-VF cardiac arrest, such as asystole and pulseless electrical activity (PEA). CPR is a combination of techniques that include chest compressions to force blood circulation, and rescue breathing to force respiration.

Properly administered CPR provides oxygenated blood to critical organs of a person in cardiac arrest, thereby minimizing the deterioration that would otherwise occur. As such, CPR can be beneficial for persons experiencing VF, because it slows the deterioration that would otherwise occur while a defibrillator is being retrieved. Indeed, for patients with an extended down-time, survival rates are higher if CPR is administered prior to defibrillation.

Advanced medical devices can actually coach a rescuer who performs CPR. For example, a medical device can issue instructions, and even prompts, for the rescuer to perform CPR more effectively. While basic instructions are helpful, providing feedback to the rescuer during CPR can improve the rescuer's ability to provide effective CPR. However, in order to provide effective feedback, an advanced medical device has to be able to measure various components of the administered CPR. This feedback can be difficult to provide because CPR is administered on a variety of surfaces, all with different amounts of flex or give. This surface differentiation can make compression depth measurements difficult to estimate. Embodiments of the invention address these and other deficiencies in the prior art.

BRIEF SUMMARY

The present description gives instances of medical devices, systems, software and methods, the use of which may help overcome problems and limitations of the prior art.

In one embodiment, a medical device for use by a rescuer who is caring for a patient includes a bottom device for use with a top device to measure the depth of Cardio Pulmonary Resuscitation (CPR) chest compressions delivered to the chest of a patient. The top device is intended for placement on the chest of the patient and has a top mechanism that is moveable up and down as the chest compressions are delivered to the patient. The bottom device includes a generally elongate member having a handle at one end and a bottom mechanism near the opposite end. The elongate member is structured to be placed underneath the patient so that at least a portion of the handle protrudes from under the patient, and the bottom mechanism, when so placed, is moveable up and down as the chest compressions are delivered. Here, during delivery of CPR, the top mechanism and the bottom mechanism cooperate to generate a value for a net depth of the compressions of the patient chest with reference to each other, even when a surface that the patient is positioned on is flexible.

In another embodiment, a method of determining compression depth during CPR is provided using the medical device described above. Here, the method includes receiving a signal that CPR has begun, measuring a top compression depth with the top mechanism, measuring a bottom compression depth with the bottom mechanism, and generating a net compression depth by comparing the measured top compression depth and the measured bottom compression depth.

In yet another embodiment, a method of determining compression depth during CPR is provided for a rescuer using the medical device described above. Here, the method includes grasping the bottom device by the handle and inserting the distal end of the bottom device under the patient. CPR compressions to a chest of a patient are then delivered that causes the chest of the patient and the surface to move up and down, where a value of a compression depth is generated by the top and the bottom mechanism. After CPR has been delivered, the bottom device is then grasped by the handle and removed from under the patient.

An advantage over the prior art is that the medical devices discussed in this description include features that provide the net depth of chest compressions delivered to a patient during CPR. By accurately gauging the net depths of these compressions, the medical device may provide feedback to a care giver so as to make the application of the CPR more effective and/or to correct any errors in treatment. In addition, the net depth measurements may be recorded and to be used as a diagnostic reference later.

These and other features and advantages of this description will become more readily apparent from the following Detailed Description, which proceeds with reference to the drawings, in which:

BRIEF DESCRIPTION OF THE DRAWINGS

FIGS. 5A, 5B, 5C, and 5D are diagrams of a scene where the medical device shown in FIG. 1 is used in a variety of positions to provide care to a patient according to embodiments.

FIG. 6 is an isometric diagram of a bottom device of the cooperating pair of medical devices shown in FIG. 3 showing bottom and side surfaces according to embodiments.

FIG. 7 is a flow diagram of a method of determining compression depth during CPR according to embodiments.

FIG. 8 is a flow diagram of another method of determining compression depth during CPR according to embodiments.

DETAILED DESCRIPTION

As has been mentioned, the present description is about medical devices, control systems, software and methods for measuring the depth of Cardio Pulmonary Resuscitation (CPR) chest compressions delivered to the chest of a patient.

Embodiments are now described in more detail.

Figure 1:
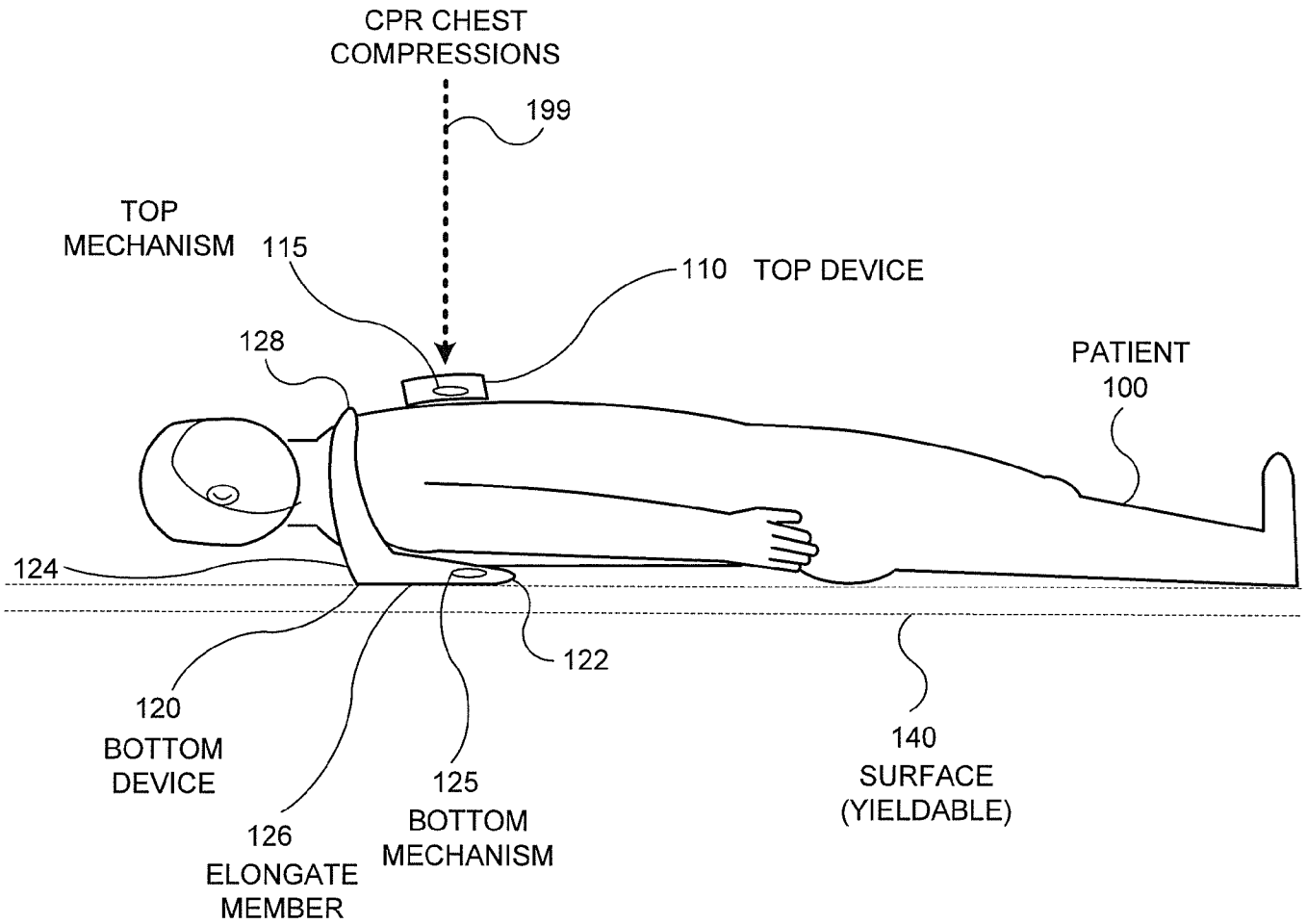
FIG. 1 is a diagram of a cooperating pair of medical devices structured to measure CPR compression depth according to embodiments.

FIG. 1 is a diagram of a cooperating pair of medical devices structured to measure CPR compression depth according to embodiments. The pair of medical devices includes a top device 110 and a bottom device 120 that work cooperatively to provide a net compression depth of CPR chest compressions 199. For illustrative purposes, FIG. 1 shows a rescue scene where a patient 100 needing CPR is placed face up on a surface 140. The surface 140 may be any type of surface where treatment can be provided. These surfaces 140 are often not completely rigid and fixed, and hence have some yield or flex when force is applied to them. For example, a patient 100 may be placed on carpet, a padded medical stretcher, a hospital bed, a surface within an ambulance, or any other type of surface that has some yield.

The top device 110 is intended for placement on the chest of the patient 100 and has a top mechanism 115 that is moveable up and down as the chest compressions 199 are delivered to the patient. The bottom device 120 includes a generally elongate member 126 having a near end 124 and a distal end 122. A handle 128 is included at the near end 124 that allows a rescuer to grasp and move the bottom device 120. Near the distal end 122, the bottom device includes a bottom mechanism 125. As shown in FIG. 1, the elongate member 126 of the bottom device 120 is structured to be placed between the patient 100 and the surface 140 so that at least a portion of the handle 128 protrudes from under the patient. With this placement, the bottom mechanism 125 is moveable up and down as the CPR chest compressions 199 cause the surface 140 to move up and down. As both the top mechanism 115 and the bottom mechanism 125 are capable of movement during the CPR chest compressions 199, they can cooperate to generate a value for a net depth of the compressions of the patient chest with reference to each other.

Figure 2:
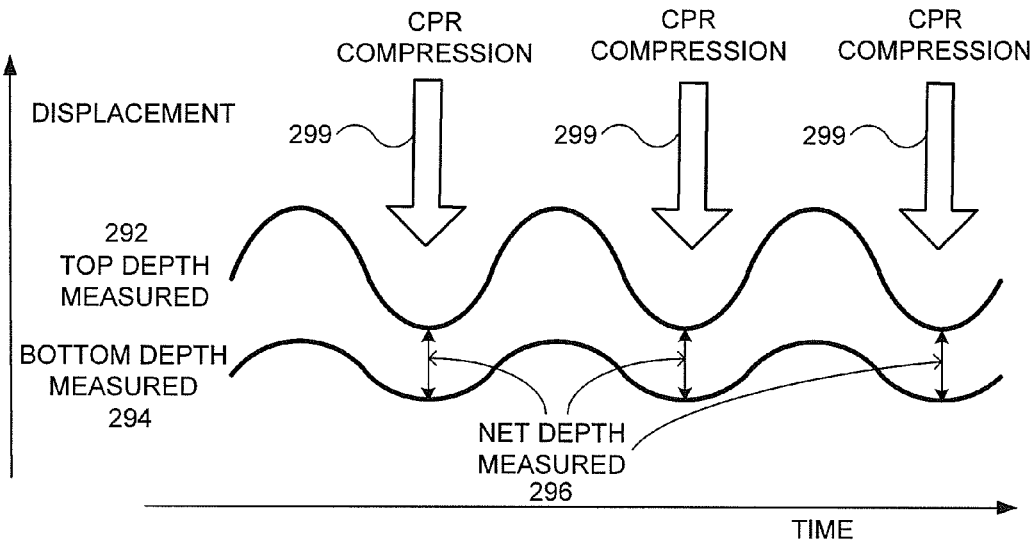
FIG. 2 is a graphical representation of determining net depth measurements during CPR compressions from the device shown in FIG. 1 according to embodiments.

FIG. 2 is a graphical representation of determining net depth measurements 296 during CPR compressions 299 from the device shown in FIG. 1 according to embodiments. Referring to FIGS. 1 and 2, a vertical axis represents displacement occurring in a vertical direction during delivery of CPR accurately approximating motion of the chest of the patient 100 and motion of the yieldable surface 140. A horizontal axis represents time. Here, a measured top depth indication line 292 correlates to measurements taken by the top mechanism 115 in the top device 110 and a measured bottom depth indication line 294 correlates to measurements recorded by the bottom mechanism 125 in the bottom device 120. As shown by these indication lines 292, 294 during CPR chest compressions 299, both the top mechanism 115 and the bottom mechanism 125 record changes in displacement due to the force of the compressions. The difference between measured top depth 292 and the measured bottom depth 294 that is recorded during the compressions 299 results in a net depth measurement 296 for the compressions. This net depth measurement 296 accurately reflects the actual depth that the chest of the patient 100 is being compressed during CPR. Since the amount of yield that the surface 140 where a patient 100 is positioned on can vary drastically depending on the surface, the top and bottom depth measurements 292, 294 may vary significantly. However, the difference between these measurements, i.e., the net depth measurement 296, will be relatively consistent for similar chest compression depths.

Figure 3:
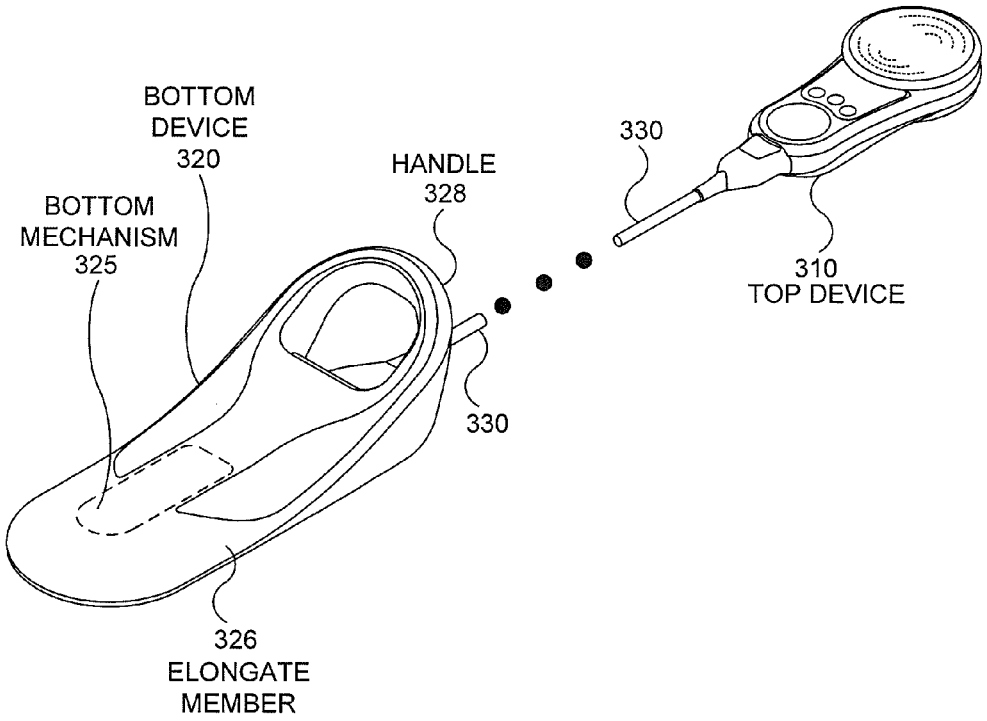
FIG. 3 is an isometric diagram of a cooperating pair of medical devices structured to measure CPR compression depth according to embodiments.

FIG. 3 is an isometric diagram of a cooperating pair of medical devices structured to measure CPR compression depth according to embodiments. In particular, FIG. 3 illustrates an example top device 310 that is intended to be placed on the chest of a patient, and an example bottom device 320 that is intended to be placed under a patient during CPR. The bottom device may include an elongate member 326 that has a width that exceeds its cross-sectional height. This shape may make it easy for the bottom device 320 to fit underneath a patient so that a bottom mechanism 325 can accurately measure displacement of a surface during CPR compressions. The bottom device also includes a handle 328, which may include, for instance, a loop, a partial loop, or other shapes for accommodating a hand. This shape of the handle 328 may allow a rescuer to push the bottom device 320 beneath the patient or pull the bottom device from beneath the patient.

In this illustrated embodiment, the top device 310 and the bottom device 320 are physically connected by a tether 330. In some embodiments, the tether 330 may be fixed to each of the top and bottom devices 310, 320. In other embodiments, however, the tether may disconnect from one or both of the top and bottom devices. The tether 330 may simply attach the top device 310 and bottom device 320 so that they do not get separated from one another. However, in other embodiments, the tether 330 may include one or more electrical connectors that transfer data and/or power from one of the top or bottom devices 310, 320 to the other one. In other embodiments, as discussed below, the top and bottom devices 310, 320 may be completely separate and communicate with one another wirelessly or by other means.

Figure 4:
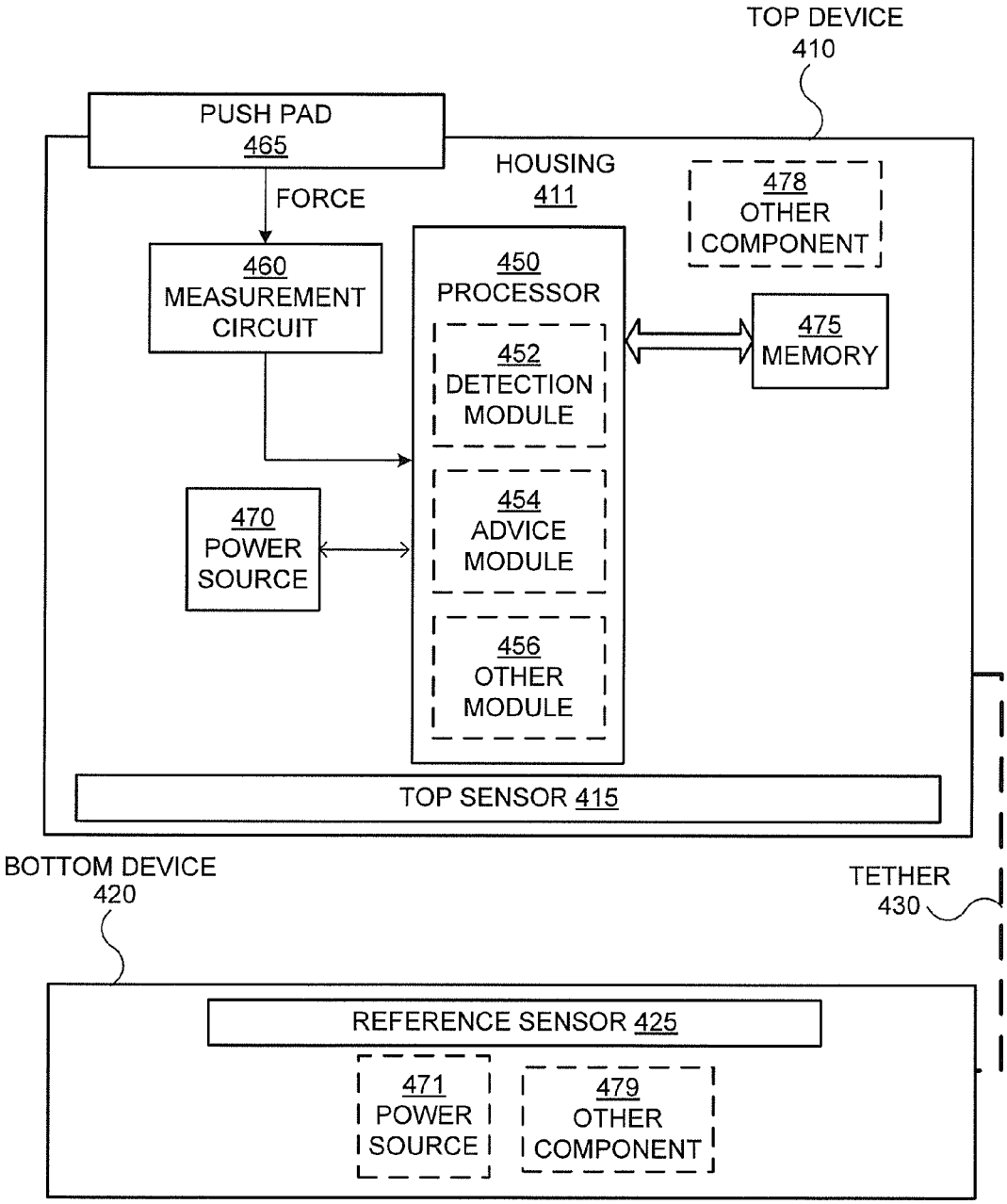
FIG. 4 is a functional block diagram of components of an exemplary device structured to measure CPR compression depth according to embodiments.

FIG. 4 is a functional block diagram of components of an exemplary device structured to measure CPR compression depth according to embodiments. In particular, the device illustrated in FIG. 4 includes a top device 410 and a bottom device 420. The top device 410 includes a processor 450, measurement circuit 460, power source 470, memory 475, and top sensor 415, all of which are encompassed in a housing 411. A push pad 465 is also part of the top device 410 and may protrude at least partially from the housing 411 so as to allow a rescuer to locate and use the push pad. When the top device 410 is placed on the chest of a patient 100 and CPR compression is started on the patient, the force applied to the push pad 465 may be measured by the measurement circuit 460 and the resulting measurement may be communicated to the processor 450. The processor may optionally include a detection module 452, an advice module 454, and one or more other modules 456. The force measurements received from the measurement circuit 460 may be detected by the detection module 452 and stored in the memory 475. The top sensor 415 may detect or indicate the displacement or travel distance of the top device 410 during CPR chest compressions. Here, the top sensor 415 may be an embodiment of the top mechanism 115 shown in FIG. 1. The top device may optionally include other components 478, such as a wireless communication module, or other modules.

The bottom device 420 includes a reference sensor 425. The reference sensor 425 may measure or indicate displacement or travel distance of the bottom device 420 during CPR chest compressions. Here, the bottom sensor 425 may be an embodiment of the bottom mechanism 125 shown in FIG. 1. The bottom device may optionally include other components 479, such as a wireless communication module, or other modules. The bottom device may also optionally include a separate power source 471, or may receive power from the power source 470 of the top device 410 through an optional tether 430.

The top device 410 and/or bottom device 420 may include a power switch to power on the respective, or both, devices. The power switches may be represented by the other component modules 478, 479. In some embodiments, the top device 410 and/or bottom device 420 may include a communication port, such as a universal serial bus (USB) port. These communication pots may again be represented by the other component modules 478, 479 in FIG. 4. The communication ports 478, 479 may allow communication between the top device 410 and bottom device 420, or may allow communication with other devices. In some embodiments, the tether 430 may be connected between the communication ports 478, 479 of the top device 410 and bottom device 420 to allow communication and data transfer between the top and bottom devices.

In some embodiments, displacement measurements may be received from both the top sensor 415 and the bottom sensor 425 so that a net displacement depth of the associated CPR compression can be calculated. These measurements may be received by the processor 450 in the top device 410 so that the processor can make the net compression depth calculation. The measurement from the reference sensor 425 may be communicated through the optional tether 430 that connects the top device 410 to the bottom device 420. Alternatively, the measurement from the reference sensor may be transmitted wirelessly from a wireless transceiver 479 in the bottom device to a wireless receiver 478 in the top device 410. A tether 430 may still be present in some embodiments that use a wireless communication protocol, or where no communication channel is required between the top device 410 and the bottom device 420, so that the two parts of the medical device do not get separated.

The top sensor 415 and reference sensor 425 may detect or measure displacement by a variety of means. In some embodiments, at least one of the top sensor 415 and the reference sensor 425 establishes a magnetic field for the other, to measure relative position. In other embodiments, the top sensor 415 and the bottom sensor 425 each include an accelerometer. In such an embodiment, acceleration data from the top sensor 415 is compared to acceleration data from the reference sensor 425 to determine a net compression depth of a CPR chest compression.

FIGS. 5A, 5B, 5C, and 5D are diagrams of a scene where the medical device shown in FIG. 1 is used in a variety of positions to provide care to a patient according to embodiments. Referring to FIG. 5A, a top device 510 is placed on the chest of a patient 500 needing CPR or other medical care. The top device may include indications (not shown) that help a rescuer effectively position the top device on the chest of the patient 500. These indications may include a reference line which corresponds to a center line 504 passing between the nipples 502 of the patient 500. The bottom device 520 may be deployed 591 under the patient 500 after the top device has been positioned on the chest of the patient.

Referring to FIG. 5B, the bottom device 520 may be positioned under the patient 500 so that the elongate member 126 (FIG. 1) positions the bottom mechanism 125 (FIG. 1) substantially under a footprint of the top mechanism 115 (FIG. 1) in the top device 510. Although the bottom mechanism does not need to be placed under the top mechanism for an accurate net compression depth to be measured in some embodiments, aligning the top and bottom mechanisms can improve the overall measurement accuracy when magnetic fields or other detection means are used to compute the net compression depth. As shown in FIGS. 5B and 5C, the elongate member can be placed under the patient from a top of the patient 500 where the handle is substantially adjacent to a head of the patient. As shown in FIG. 5D, the elongate member may alternatively be placed from a side of the patient 500 where the handle is substantially adjacent to a ribcage of the patient. The actual location and position of the lower device 520 may be determined by the rescue environment and the ease in which the lower device can be placed under the patient 500.

FIG. 6 is an isometric diagram of a bottom device 620 of the cooperating pair of medical devices shown in FIG. 3 showing bottom and side surfaces according to embodiments. In particular, FIG. 6 illustrates that some embodiments of the bottom device 620 include a slide portion 626 and a grip portion 627 on the bottom surface. The slide portion 626 may allow the bottom device to be easily placed under a patient or removed from under a patient, while the grip portion or surface 627 may help keep the bottom device in place under a patient once it is placed and during delivery of CPR. As the grip portion 627 is closer to a handle of the bottom device 620, when a rescuer pulls up on the handle of the bottom device, the grip portion may lose contact with a surface that the patient is lying on thereby allowing the bottom device to be easily inserted or removed by sliding it on the smooth surface of the slide portion 626.

FIG. 7 is a flow diagram of a method of determining compression depth during CPR according to embodiments. Although this flowchart illustrates a variety of operations in a particular order, these operations may be carried out in different orders to achieve similar results in other method embodiments. In particular, FIG. 7 illustrates a method of determining compression depth during CPR being performed on a patient placed on a surface using a top device placed on a chest of the patient and using a bottom device placed under the patient according to embodiments. The top device may have a top mechanism while the bottom device may have a handle at a near end and a bottom mechanism at a distal end. The method shown in this illustrated flow chart may be practiced, for example, by the top and bottom devices shown in FIG. 1.

According to an operation 710, an indication of CPR beginning is received. This indication may be a manual input from a rescuer, or may be triggered automatically when the top device and bottom device are closely aligned and/or substantial force is received on a push pad of the top device. According to another operation 720, a top compression depth is measured by the top mechanism in the top device. A bottom compression depth is also measured by the bottom mechanism according to another operation 730. The top and bottom compression depths may, for example, include acceleration data correlating to the depth of CPR chest compressions being delivered to the patient.

According to another operation 740, a net compression depth is generated by comparing the top compression depth and the bottom compression depth. In some embodiments, this operation includes receiving the top and bottom compression depths and subtracting the bottom compression depth from the top compression depth. In other embodiments, this operation includes determining a differential reference distance between the top mechanism and bottom mechanism immediately prior to a compression, and during a CPR chest compression. The differential in these reference distances may correlate to the net compression depth of the CPR chest compression.

According to an option operation 750, a user-feedback signal may be outputted to a rescuer based on the net compression depth. This user-feedback signal may include a visual signal and/or an auditory signal. For example, if the measured net CPR chest compression is within a desired range, a green light may be shown on the top device. On the other, if a measured net CPR chest compression is too light to be effective or too strong to be safe for the patient, a red light may be flashed on the top device, or an auditory tone or voice may be generated to warn the rescuer of the need to adjust the force or timing of the CPR chest compressions. That is, a user-alert signal may be outputted when the generated net compression depth is outside of a predefined range.

According to another optional operation 760, the measured net compression depth may be recorded or otherwise saved. This depth may be recorded in the memory of the top device for use later in diagnostic processing of the rescue. The data may also be used for calibrating the top and bottom devices or for testing them.

FIG. 8 is a flow diagram of another method of determining compression depth during CPR according to embodiments. Although this flowchart illustrates a variety of operations in a particular order, these operations may be carried out in different orders to achieve similar results in other method embodiments. In particular, FIG. 8 illustrates a CPR process used by a rescuer employing the top and bottom device described above in FIG. 7. That is, FIG. 8 illustrates a method of determining compression depth during CPR being performed on a patient placed on a surface using a top device placed on a chest of the patient and using a bottom device placed under the patient according to embodiments. The top device may have a top mechanism while the bottom device may have a handle at a near end and a bottom mechanism at a distal end. The method shown in this illustrated flow chart may be practiced, for example, with the top and bottom devices shown in FIG. 1.

According to an operation 810, a rescuer grasps the bottom device by the handle. Then, according to another operation 820, the rescuer inserts the distal end of the bottom device under the patient. In some embodiments, inserting the distal end of the bottom device under the patient includes placing the distal end of the bottom device under the patient where the bottom mechanism is located substantially under a footprint of the top mechanism. In these embodiments, inserting the distal end of the bottom device under the patient may include inserting the bottom device under the patient where the handle is substantially adjacent to a ribcage of the patient. Alternatively, in these embodiments, inserting the distal end of the bottom device under the patient may include inserting the bottom device under the patient where the handle is substantially adjacent to a head of the patient.

According to another operation 830 CPR compressions are delivered to a chest of a patient that causes the chest of the patient and the surface to move up and down, where a value of a compression depth is generated by the top and the bottom mechanism. After CPR has been completed, another operation 840 is employed in which the bottom device is again grasped by the handle and removed from underneath the patient.

Here, the value of the compression depth may be generated by comparing a value measured by the top mechanism with a value measured by the bottom mechanism. Further, during application of the CPR chest compressions, an outputted signal based on the generated compression depth value may be generated for the rescuer.

In this description, numerous details have been set forth in order to provide a thorough understanding. In other instances, well-known features have not been described in detail in order to not obscure unnecessarily the description.

A person skilled in the art will be able to practice the present invention in view of this description, which is to be taken as a whole. The specific embodiments as disclosed and illustrated herein are not to be considered in a limiting sense. Indeed, it should be readily apparent to those skilled in the art that what is described herein may be modified in numerous ways. Such ways can include equivalents to what is described herein. In addition, the invention may be practiced in combination with other systems.

The following claims define certain combinations and subcombinations of elements, features, steps, and/or functions, which are regarded as novel and non-obvious. Additional claims for other combinations and subcombinations may be presented in this or a related document.

What is claimed is:

1. A bottom device for use with a top device to measure depths of Cardio Pulmonary Resuscitation (CPR) chest compressions delivered to the chest of a patient placed face up on a surface, the top device intended for placement on the chest of the patient and having a top mechanism that is moveable up and down as the chest compressions are delivered to the patient and configured to measure displacement of the top device during the chest compressions, the bottom device comprising:

a generally elongate member having a near end and a distal end, the distal end configured to be placed under the chest of the patient;

a handle at the near end for grasping the elongate member;

a bottom mechanism positioned proximately at the distal end, and a slide portion disposed on an underside of the bottom device, near the distal end, and configured to slide with respect to a surface, and a grip portion disposed toward the near end relative to the slide portion, the grip portion having a surface less smooth than the slide portion and configured to restrict movement on the surface on a bottom surface of the bottom device, in which:

the elongate member is configured to be placed between the patient and the surface so that at least a portion of the handle protrudes from under the patient, when the bottom mechanism is placed between the patient and the surface, the bottom device is moveable up and down as the chest compressions cause the surface to move up and down and the bottom mechanism is configured to measure displacement of the bottom device during the chest compressions, and the top mechanism and the bottom mechanism are configured to cooperate to generate a value for a net depth of the compressions of the patient chest with reference to each other based on the displacement of the top mechanism and a displacement of the bottom mechanism.

2. The device of claim 1, in which the top mechanism comprises a top sensor and the bottom mechanism comprises a reference sensor.

3. The device of claim 1, in which the elongate member is structured to be placed so that the bottom mechanism becomes located substantially under a footprint of the top mechanism.

4. The device of claim 1, in which the elongate member is configured to be placed under the patient from a side of the patient where the handle is substantially adjacent to a ribcage of the patient.

5. The device of claim 1, in which the elongate member is configured to be placed under the patient from a top of the patient where the handle is substantially adjacent to a head of the patient.

6. The device of claim 1, in which the elongate member has a width that exceeds its cross-sectional height.

7. The device of claim 1, in which the handle includes an elevated loop.

8. The device of claim 1, in which the handle is shaped so as to allow a rescuer to push the bottom device beneath the patient or pull the bottom device from beneath the patient.

9. The device of claim 1, in which at least one of the top mechanism and the bottom mechanism establishes a magnetic field for the other.

10. The device of claim 1, in which the top mechanism and the bottom mechanism communicate wirelessly with each other using a wireless transmitter.

11. The device of claim 1, in which the top mechanism and the bottom mechanism include separate power sources.

12. The device of claim 1, in which one of the top mechanism and the bottom mechanism include an accelerometer.

13. The device of claim 1, in which the bottom device is adapted to be coupled with the top device via a tether.

14. The device of claim 13, in which the tether is structured to directly communicate measured data from the bottom device to the top device.

15. The device of claim 13, in which the tether is structured to provide power to components of the bottom device from a power source in the top device.

16. A method of determining compression depth during Cardio Pulmonary Resuscitation (CPR) being performed on a patient placed on a surface using a top device placed on a chest of the patient, the top device having a top mechanism, and using a bottom device inserted under the patient, the bottom device comprising a generally elongate member having a handle at a near end of the bottom device and having a bottom mechanism at a distal end of the bottom device, the distal end configured to be placed under the chest of the patient, and a slide portion disposed on an underside of the bottom device, near the distal end, and configured to slide with respect to a surface, and a grip portion disposed toward the near end relative to the slide portion, and configured to restrict movement on the surface on a bottom surface of the bottom device by the grip portion having a surface that is rougher than the slide portion, the method comprising:

receiving a signal that CPR has begun;

measuring a top compression depth with the top mechanism;

measuring a bottom compression depth with the bottom mechanism; and generating a net compression depth by comparing the measured top compression depth and the measured bottom compression depth.

17. The method of claim 16, further comprising:

recording the net compression depth.

18. The method of claim 16, further comprising:

outputting a user-feedback signal based on the generated net compression depth.

19. The method of claim 18, further comprising:

outputting a user-alert signal when the generated net compression depth is outside of a predefined range.

20. A method of determining compression depth during Cardio Pulmonary Resuscitation (CPR) being performed on a patient placed on a surface using a top device having a top mechanism and using a bottom device comprising a generally elongate member having a handle at a near end of the bottom device and having a bottom mechanism at a distal end of the bottom device, the distal end configured to be placed under the chest of the patient, and a slide portion disposed on an underside of the bottom device, near the distal end, and configured to slide with respect to a surface and a grip portion disposed toward the near end relative to the slide portion, and configured to restrict movement on the surface on a bottom surface of the bottom device by the grip portion having a surface that is rougher than the slide portion, the method comprising:

grasping the bottom device by the handle;

inserting the distal end of the bottom device under the patient;

delivering CPR compressions to a chest of a patient that causes the chest of the patient and the surface to move up and down, where a value of a compression depth is generated by the top and the bottom mechanism; and then grasping the bottom device by the handle and removing the bottom device from under the patient.

21. The method of claim 20, further comprising:

receiving an outputted signal based on the generated compression depth value.

22. The method of claim 20, in which:

the value of the compression depth is generated by comparing a value measured by the top mechanism with a value measured by the bottom mechanism.

23. The method of claim 20, in which:

inserting the distal end of the bottom device under the patient includes placing the distal end of the bottom device under the patient where the bottom mechanism is located substantially under a footprint of the top mechanism.

24. The method of claim 23, in which:

inserting the distal end of the bottom device under the patient includes inserting the bottom device under the patient where the handle is substantially adjacent to a ribcage of the patient.

25. The method of claim 23, in which:

inserting the distal end of the bottom device under the patient includes inserting the bottom device under the patient where the handle is substantially adjacent to a head of the patient.

* * * * *